US005657583A

United States Patent [19]

Tennant

[11] Patent Number: 5,657,583

[45] Date of Patent: Aug. 19, 1997

[54] PORTABLE KNOCK-DOWN UTILITY SHED

[76] Inventor: Donald Tennant, 304 Carey Ave., Gillette, Wyo. 82716

[21] Appl. No.: 562,588

[22] Filed: Nov. 24, 1995

[51] Int. Cl.[6] ..... E04C 2/40

[52] U.S. Cl. ..... 52/79.5; 52/270; 52/588.1; 52/591.1; 52/591.4; 52/641; 52/646

[58] Field of Search ..... 52/79.5, 641, 646, 52/591.1, 591.4, 588.1, 270, 281, 585.1

[56] References Cited

U.S. PATENT DOCUMENTS

| | | | |
|---|---|---|---|
| 3,307,894 | 3/1967 | Collier | 52/281 X |
| 3,547,472 | 12/1970 | Ehrman | 52/281 X |
| 3,632,146 | 1/1972 | Buzby et al. | 52/281 X |
| 4,454,694 | 6/1984 | Davanture | 52/270 |
| 4,570,392 | 2/1986 | Oltamn et al. | 52/79.5 X |

*Primary Examiner*—Christopher T. Kent
*Attorney, Agent, or Firm*—Charles C. Corbin

[57] ABSTRACT

Disclosed is a quick-assembly and knock-down, portable utility shed formed of releasably interlockable front, rear, and opposing side wall panels, and roof panels. The opposite vertical edges of the front and rear panels, and the side panels, respectively, are characterized by releasably latchable tongue-and-groove structure. The upper portions of the front and rear panels have a gable structure and include a pair of support members that slope downwardly from an apex. The shed is completed by a pair of roof panels that are releasably secured to the side panels and the gable structure of the front and rear panels. Each panel comprises a support frame to which exterior siding is affixed, and the siding of each panel has edge portions that are releasably interconnectable with edge portions of the siding of an adjacent panel.

12 Claims, 4 Drawing Sheets

PORTABLE KNOCK-DOWN UTILITY SHED

BACKGROUND OF THE INVENTION

1. Field of the Invention

The present invention relates to portable building structures, and more particularly to a utility shed structure that can be easily assembled and knocked down without the use of special tools.

2. Description of the Prior Art

In certain industries, such as the construction industry in particular, there is always the need for providing temporary shelter, security, and storage for tools, equipment, machinery, and supplies. Trailer-type buildings are typically too expensive and complex for these purposes. Prefabricated sheds are more suited for such temporary storage purposes, and a variety of them are commercially available; however, these pre-built structures do not lend themselves to transportation from one temporary site to another since they require special handling and transportation by a truck or flatbed trailer, and repeated moving can adversely affect the structural stability of such sheds. Furthermore, such commonly available utility sheds and the like are designed to be assembled permanently and permanently installed at a business, commercial or residential location, and cannot be conveniently disassembled for transport and reassembled. Such pre-built sheds can also be relatively expensive.

In an attempt to address these needs, the prior art reveals a few developments of portable building structures that are designed to be disassembled and re-erected as required. See U.S. Pat. Nos. 117,721, 2,231,065, and 4,676,039 for examples. While these patented systems have their particular advantages, they unfortunately also have their limitations and shortcomings. The disclosure of U.S. Pat. No. 117,721 discloses a system that calls for peculiar shaped bolts and elongate vertical weather strips for forming corners for wood plank side wall panels, and several such bolts per corner must be installed using a special hand tool. Such a design would not appear to lend itself to modern materials and structures, requires too much labor, and does not appear to have the durability required for repeated use. U.S. Pat. No. 2,231,065 shows an easy-assembled sheet metal building that uses interconnectable side wall and roof sections. Vertical edges of the panels are prefolded to form channels and flanges that can be slidably connected to each other to form corner joints. Although such a building can be assembled without special tools, it appears that an appreciable amount of labor will nevertheless be required for the longitudinal sliding movement required for each joint and the deleterious effects of corrosion and distortion of the sheet metal over time make such developments unsuitable for repeated assembly and disassembly for which use it is clearly not intended. U.S. Pat. No. 4,676,039 shows a portable building that is designed to be easily assembled as well as knocked down. It relies on specially shaped vertical edges on its side panels and a separate specially shaped corner post to interconnect one side panel to another to form a building corner. Among the limitations of such design it is noted that the extruded components are somewhat complex, and unfortunately a considerable amount of rotation of each panel is required to connect a panel to a corner post, which can be an inconvenient and time consuming maneuver.

SUMMARY OF THE INVENTION

In view of the foregoing, it is a general object of the present invention to provide a portable utility shed that is relatively inexpensive, and which can be easily and conveniently assembled as well as disassembled.

Another object of the invention is to provide a knock-down portable shed having component parts that can be easily handled and efficiently transported from one site to another, and which can be easily loaded and unloaded from a transportation vehicle.

A further object is to provide such a portable shed that is highly durable, and capable of being repeatedly assembled, disassembled, and transported without adversely affecting the structural stability of the unit.

Yet another object of the present invention is to provide a portable knock-down shed that includes exterior siding that has vertical edge portions that are easily disconnectable and connectable to each other to provide weather-tight corner connections.

These and other objects and advantages are provided by the present invention of an easy disassemble and assemble, portable shed comprised of releasably interlockable front, rear, and opposing side wall panels, and roof panels, wherein each of said panels comprises a support frame structure to which an exterior siding is affixed.

The opposite vertical edges of the frame of each side panel features a tongue member that lies in the plane of the panel and is elongated vertically as a single member for substantially the height of the panel edge, and a first and a second transversely extending latch pin-receiving hole is provided respectively in an upper portion of the tongue member and in a lower portion of the tongue member. The support frames of the front and the rear wall panels each have opposite vertical edges characterized by a single vertically extending groove, normal to the plane of the panel, and adapted to snugly receive therein the tongue member of a side wall panel, the tongue having a seated, installed position wherein a pair of vertically extending parallel wall members are spaced apart to provide said groove, and a first latch hole extends horizontally, in the plane of the panel, through the upper portion of the spaced-apart, groove-forming members, and a second latch hole similarly extends through the lower portions of the spaced-apart members. When the tongue member is seated, these latch holes are alignable with the upper and lower holes of the tongue member, and a latch pin is removably engagable in the aligned holes to releasably secure the tongue member in the groove. Thus, the side panels and the front and rear panels are easily connectable to each other to form a four-walled structure.

The upper portions of the frame structure of the front and the rear wall panels are each characterized by a gable structure that includes first and second members that slope downwardly from a central apex, and adjacent said apex there is secured a first male connector element that projects generally horizontally in a direction generally parallel to the plane of the panel, and there is a second such male connector element that projects in the opposite direction of said first male connector element.

There are a pair of roof panels, the frame of each including opposite parallel side members and lower and upper parallel members, the lower member adapted to engage the upper horizontal frame of a side panel, and the opposing side walls adapted to engage the upper portions of the sloped gable members of a front and a rear panel for vertical support. Adjacent the side member of each roof panel there is socket means for releasably engaging a male connector element to hold said roof frame against upward or lateral movement relative to the gable structure, and there is releasable latch means effective between the upper frame of a side panel and the lower frame member of a roof panel to releasably secure these parts, one to the other. This arrangement permits each roof panel to be easily and quickly secured to the four-walled structure that is provided when the opposing side wall panels and front and rear panels are conveniently connected in the manner mentioned above, this being accomplished by first engaging the socket means of each roof panel in the respective male elements and then connecting the lower frame member to the side panel frame as mentioned above.

The invention also features an exterior cover or siding of a polymeric sheet material affixed to the frame of each side panel and front and rear panel, the siding of each such panel featuring vertical edge portions adapted to be positioned in overlapping relationship with an edge portion of the siding of an adjacent panel, and a vertically extending slot in one edge portion is releasably engagable by a vertically extending projection from the other siding edge portion so as to releasably connect the overlapping portions and to form a weather-tight corner for the assembled shed.

DETAILED DESCRIPTION OF THE INVENTION

Figure 1:
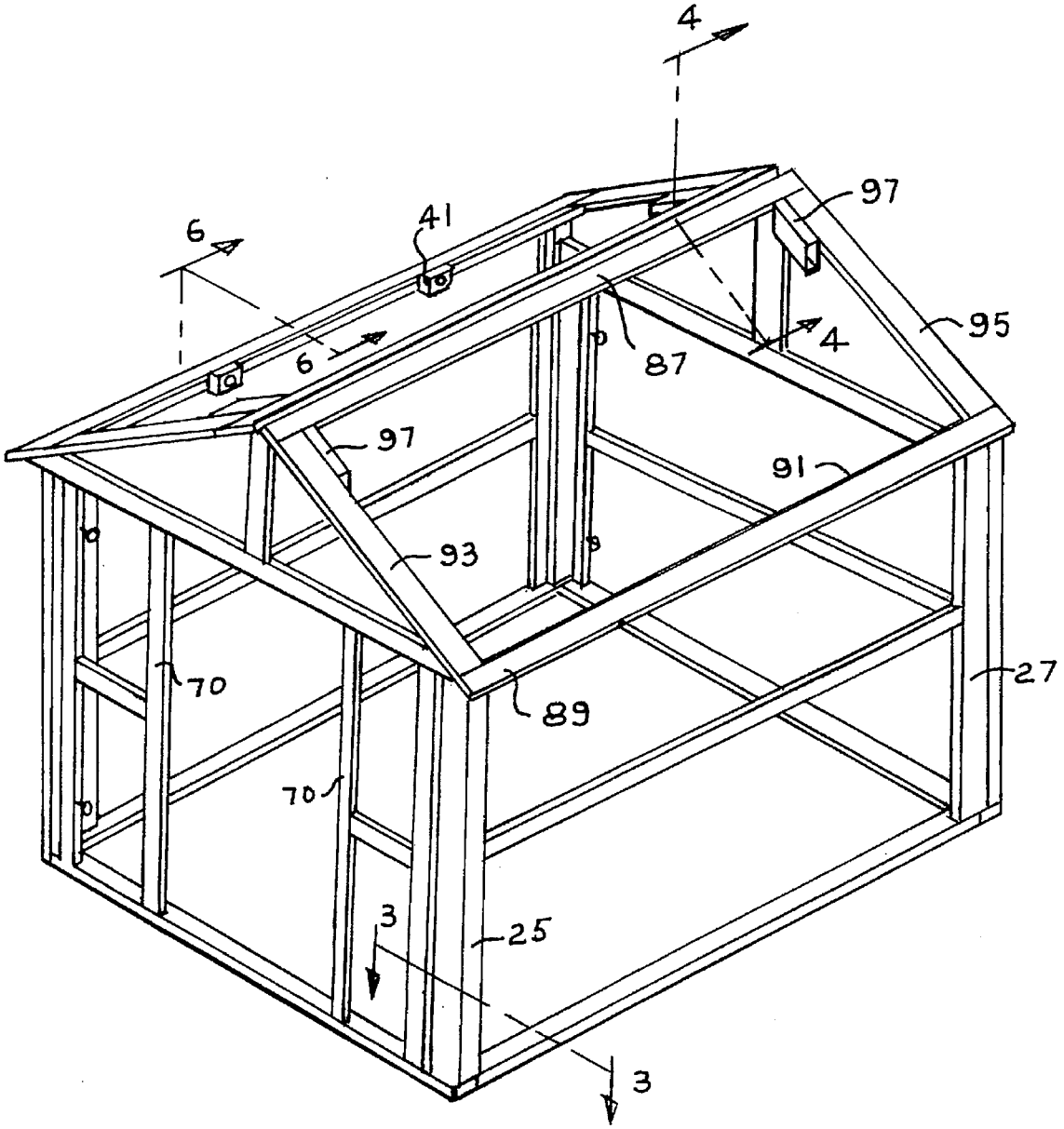
FIG. 1 is a perspective view of a preferred embodiment of a quick-assembly, and knock-down shed according to the present invention, with siding removed for the sake of clarity.
Figure 2:
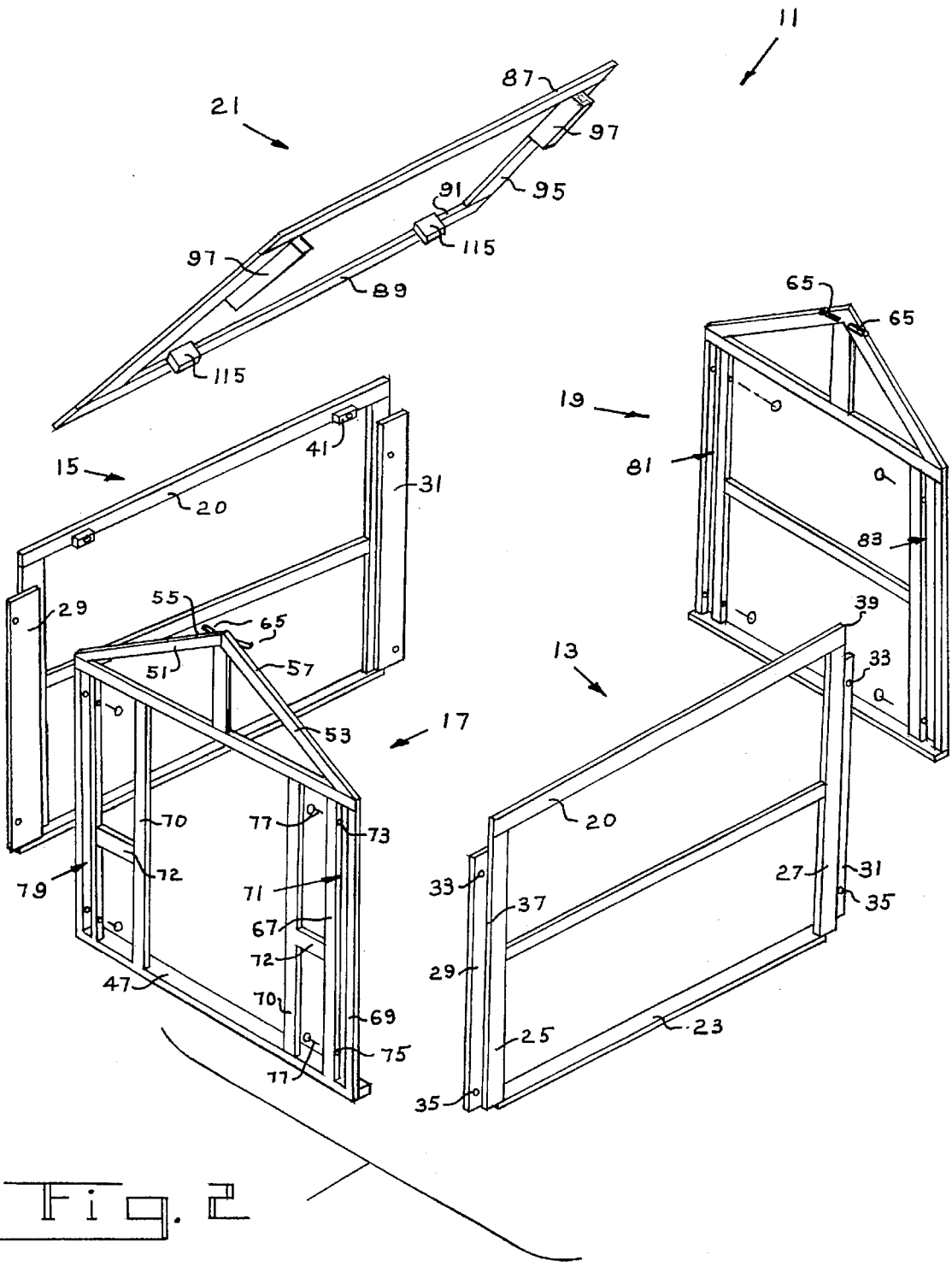
FIG. 2 is an exploded, perspective view of the shed of FIG. 1 with only one roof panel frame shown for the sake of clarity.

Referring now to the drawings, FIGS. 1 and 2 show a preferred embodiment 11 of a portable knock-down utility shed assembly according to the present invention, the uniquely connectable exterior siding (to be later described) not being shown for the sake of clarity, so as to best illustrate the way in which the underlying support framework of the panels interconnect quickly and conveniently to form a very durable, stable erected structure such as shown in FIG. 1.

FIG. 2 best shows that the main components of assembly 11 include a pair of opposing side panel frames 13 and 15, a front panel frame 17 and a rear panel frame 19, and a roof panel frame 21 (the other roof panel frame not shown). In this preferred embodiment, the frame structure is fabricated of suitable channel stock of steel or a lightweight alloy according to techniques well known in the metal working and welding industry. Under the invention, it is also contemplated to fabricate the support framework of a reinforced plastic material, of suitable durability and strength, using thermal forming, vacuum molding, or other techniques well known in the plastic fabrication industry.

Referring back to FIG. 2, it is noted that side frames 13 and 15, which are mirror images of each other, each include a top horizontal member 20, a bottom member 23, and opposing side members 25 and 27. First and second tongue members 29 and 31 are affixed respectively to the side members 25 and 27, each tongue member being provided with an upper, horizontally extending latch pin-receiving hole 33 and a lower such hole 35. Note that frame 15 and frame 13 have a pair of quick-throw clamp-type latches 41 secured to their top members 20. Latches 41 will be discussed later in conjunction with a description of the roof panel frame 21.

The exterior side of these frame members are seen to provide flat surfaces to which the exterior siding is conveniently affixed, as will be explained later. The bottoms of the lower members 23, and the lower members of the front and the rear panel frames, to be described, are adapted to engage the ground.

The front panel frame 17 and the rear panel frame 19 each include a lower horizontal member 47 and an upper portion having gable structure including sloped members 51 and 53 which provide flat support surfaces 55 and 57 respectively. Welded to the interior surfaces of gable members 51 and 53, near the apex of the gable structure, are first and second male connecting members 65, to be described later. One end of front frame 17 has parallel vertical members 67 and 69 that are spaced apart to provide a groove 71 that is designed to snugly receive the side frame tongue 29, and there are a first set of horizontally aligned pin-receiving holes 73 in the upper part of members 67 and 69, and a second set of such holes 75 is provided in the lower portion of these members, and holes 73 will be seen to be alignable with tongue hole 33, and holes 75 alignable with tongue hole 35, when tongue 29 is fully inserted in the groove 71.

Latch pins 77 are releasably engagable in the above-mentioned pin-receiving holes when a corner connection is made between panels, as will be described hereinafter. The opposite end of front frame 17 has structure that mirrors the first end and provides a groove 79 that is adapted to receive the tongue 29 of side frame 15, and will form a connection essentially the same as the connection at the other end of front frame 17.

Front panel frame 17 also includes door frame structure comprising parallel upright posts 70 and braces 72. It should be evident to those of ordinary skill in the art that any number of conventionally designed doors can be mounted to posts 70, including a hinged door (not shown) having a frame of welded metal stock that is covered with a suitable exterior siding material.

The rear panel frame 19, except for the door frame structures is essentially the mirror of the front panel frame 17 and no detailed description is warranted save to note that first and second grooves 81 and 83 are provided for receiving the tongue members 31 of the side frames 15 and 13 respectively.

Using as few as two workers, the above-described four panel frames can be quickly connected together along their connecting edges to form a free-standing partially erected shed structure standing on a generally level surface. To accomplish this, the upright side frame 13 can be held at about 90° to the upright front frame 17 and the tongue member 29 maneuvered in the groove 71, and then the latch pins 77 engaged in aligned holes to form a corner connection shown in FIG. 1, and in detail in FIG. 3.

Figure 3:
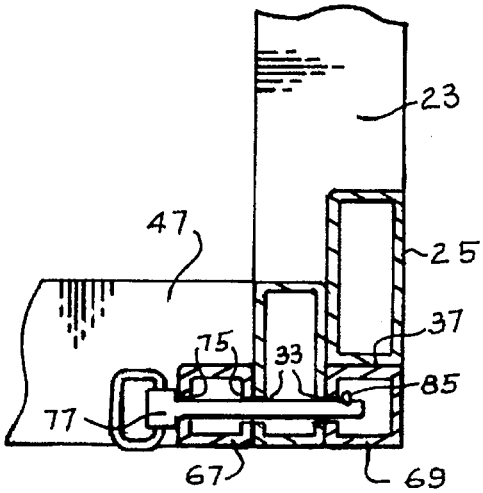
FIG. 3 is an enlarged sectional view taken along the line 3—3 of FIG. 1.

Thus, FIG. 3 shows how the shaft of latch pin 77 is fully inserted to secure the tongue member 29, there being a resiliently depressible detent ball 85 that engages the inside perimeter of hole 75 to releasably retain the pin 77. Note that the flat edge 37 of member 25 abuts member 69 to help provide a stable connection against freedom of motion in several directions. In essentially the same manner, the tongue member 29 of the other side frame 15 can be quickly connected to the groove 79 of front frame 17, and likewise the tongue members 31 of the side frames 13 and 15 are quickly connected to the grooves 83 and 81 respectively, of the rear frame 19 to complete the partial erection of the assembly 11.

The roof frames 21 are structured as follows to allow them to be quickly secured to the four erected panels to structurally tie all of the panel frames together and to enhance the stability of the entire interconnected assembly. FIGS. 1 and 2 show that a roof frame 21 includes upper member 87, horizontal eave member 89 and adjoining support member 91, a front member 93, and a rear member 95. It will be seen that the flat under-surfaces of the front and rear members 93 and 95 are adapted to engage the gable support surfaces 57 of the opposing frames 17 and 19, the adjoining support member 91 having a horizontal lower surface, best shown in FIG. 6, for engaging the top surface of side frame member 20. Each roof frame 21 also has secured thereto a pair of female connector elements 97 which are designed to be easily brought into releasable engagement with the male connector elements 65 in a manner to hold the upper part of roof frame 21 firmly against movement in all directions except outwardly for disengagement. The male elements 65 extend generally horizontally, and as FIG. 5 best shows, they have first ends welded to the gable members and other portions 99 that are inclined, as viewed from above in FIG. 5, to the surface 101.

Female connecting element 97 has walls that define an opening 103 for receiving the male element portion 99, and outer wall 105 provides a flat vertical surface designed to be seated flatly against the gable surface 101. Note that the female connector 97 is oriented at 90° to the roof member 87. It can also be appreciated by reference to FIG. 5 that opening 103 has an edge 107 that is designed to slidably engage the inclined surface (as viewed in FIG. 5) 109 of male element portion 99. In addition, FIG. 4 best shows how opening 103 has another edge 111 for slidably engaging the under-surface 113 of male element portion 99. Thus the upper portions of a roof frame 21 can be releasably secured to the gable structures as follows. The upper member 87 can be positioned against gable support surfaces 57 with the openings 103 in general alignment with the male element portions 99. Frame 21 can then be slid upwardly along surfaces 57 to bring the element portions 99 within openings 103. By reference to FIG. 5, it can be appreciated how, as the roof frame is slid upwardly, the opening edge 107 will engage male element surface 109 to become wedged and to help urge the wall 105 against gable surface 101 to maintain a 90° relationship between the frames, as viewed in FIG. 5. By reference to FIG. 4, it is appreciated how the opening edge 111 will slidably engage the male element surface 113 to urge the roof member 95 against the support surface 57.

Figure 5:
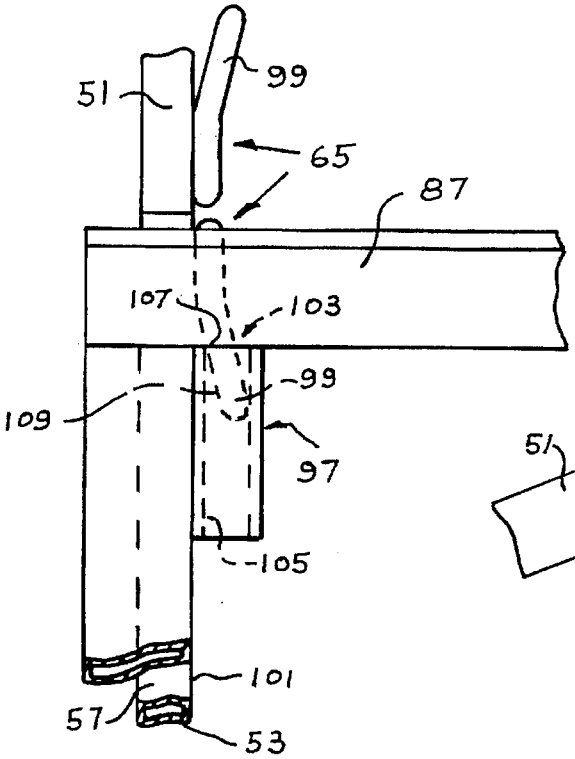
FIG. 5 is an enlarged, partial plan view of the upper corner region of the roof panel of the embodiment shown in FIG. 1.
Figure 4:
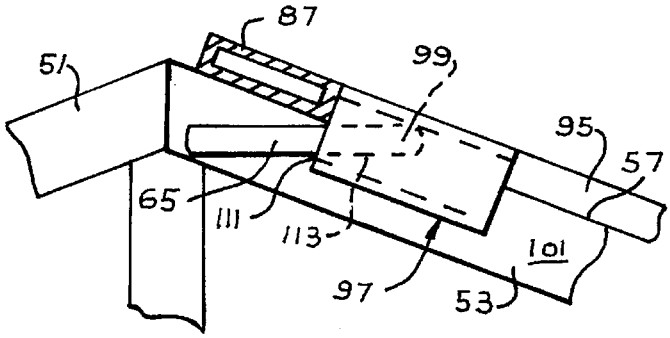
FIG. 4 is an enlarged, partial sectional view taken along the line 4—4 of FIG. 1.

It should also be appreciated by reference to FIGS. 4 and 5 how the flat vertical outer surface 102 of each of the female elements 97 fit against the gable surface 101 at each side of the roof frame to help hold the upper portion of the roof panel against lateral or pivoting movement relative to the gable structure.

Figure 6:
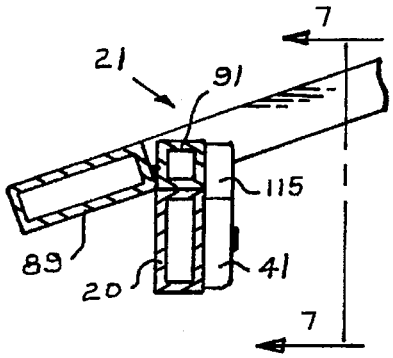
FIG. 6 is a sectional view taken along the line 6—6 of FIG. 1.
Figure 7:
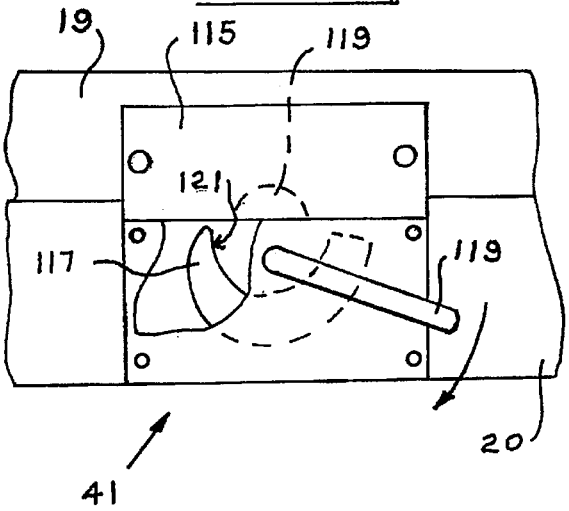
FIG. 7 is a partial, elevational view taken along the line 7—7 of FIG. 6.

The FIGS. 6 and 7 best show how the lower portion of a roof frame 21 is supported by and releasably secured to a member 20 of a side panel frame. After the upper portion of frame 21 is installed as mentioned above, its lower portion can be positioned so that the lower surface of member 71 is supported by the top of member 20, which also brings the cam-latch 41 in alignment with a latch receiver 115 that is affixed to the member 91. The mechanism of latch 41 includes a rotatable latch blade 117, and a handle 119 secured to the hub of blade 117, for rotating blade 117, here shown in an unlatched position. In some commercially available devices of this type, instead of a handle 119, an Allen wrench can be instead used to engage the hub of the latch. Latch receiver 115 provides a surface 119 that is slidably engaged by a surface 121 of blade 117 as blade 117 is rotated upwardly from the position shown in FIG. 7. A resulting cam-like action urges receiver 115 downwards to a secured position in which the member 91 is held firmly engaged against member 20. Thus, the two roof frames 21 can be quickly installed to provide the completely erected framework as shown in FIG. 1.

Figure 8:
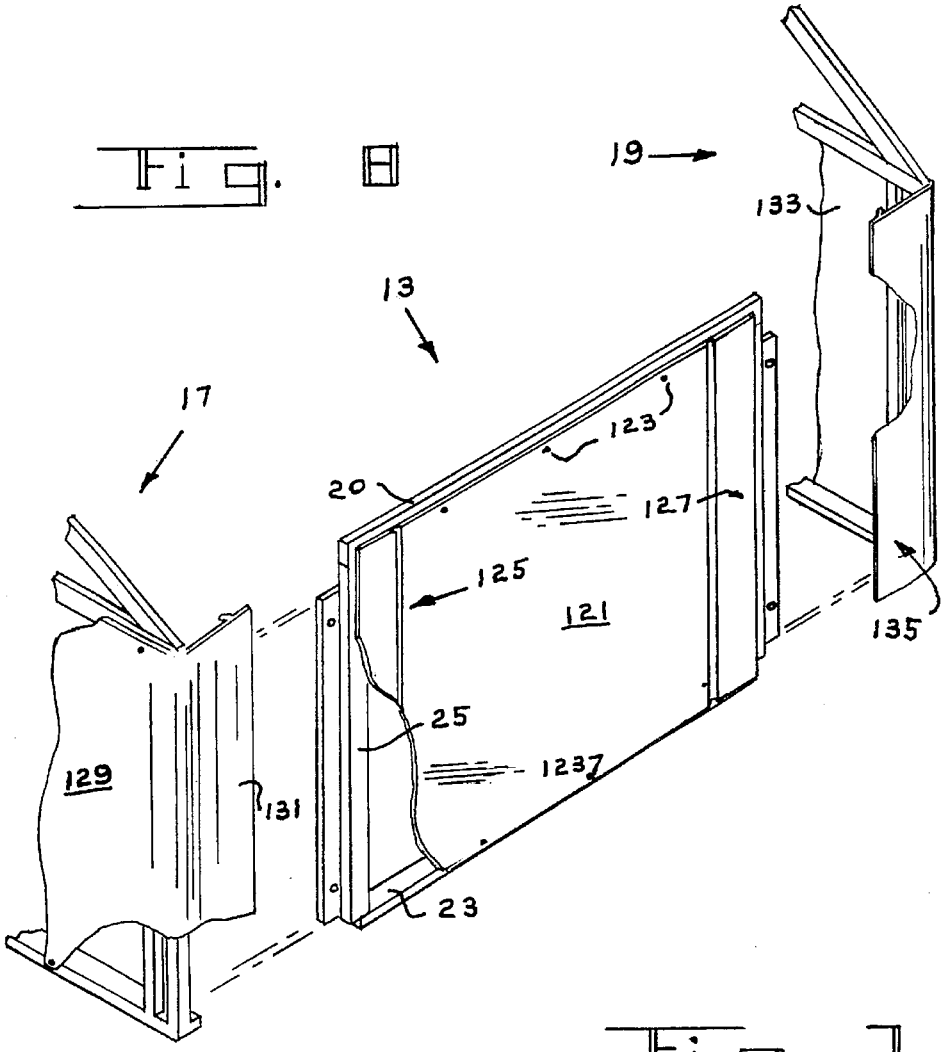
FIG. 8 is a partial, perspective view illustrating the siding used in a preferred embodiment of the invention.
Figure 9:
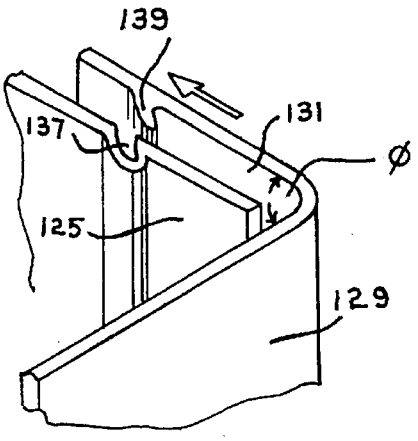
FIG. 9 is an enlarged perspective view illustrating the connectable edge portions of siding shown in FIG. 8.

FIGS. 8 and 9 illustrate the exterior siding or cover that is used in the preferred embodiment of the invention. FIG. 8 shows siding that comprises a sheet 121 of a suitable plastic material, such as polyurethane, that is affixed to the side frame 13 using rivets 123, and it features a first interconnectable edge portion 125 at one end and a second interconnectable edge portion 127 at the opposite end. A siding sheet 129 is affixed to the front frame 17, and it features a flap 131 that is releasably connectable to the edge portion 125 of adjoining sheet 121, in a manner to be described. Similarly, a siding sheet 133 is affixed to the rear frame 19, and it features a connecting flap 135 that can be connected to the edge portion 127.

FIG. 9 best illustrates how siding flap 131 is connectable to the edge portion 125 after frame 13 has been connected frame 17. First it is noted that edge portion 125 is equipped with a groove 137, and flap 131 with a tongue 139, and the angle $\phi$ between the flap 131 and the main siding 129 is slightly less than 90°, the effect of which is to cause the tongue 139 to be resiliently urged toward the edge portion 125 to facilitate the making of a connection, to be described. It is also noted that when these interconnectable siding portions are overlapped as shown in FIG. 9, the tongue 139 is disposed just short of the groove 137; however, flap 131 can be resiliently deformed in the direction indicated by the arrow to allow a tongue-and-groove connection to be made. Note that the inclination of the tongue-and-groove allows tongue 139 to be "hooked" and retained within groove 137. In a similar fashion, the flap 135 is connectable to the groove 127. It should be appreciated that the siding at the other corners of the erected structure are similarly made.

While a particular embodiment of the invention has been described herein, it is not intended that the invention be limited thereto, since various modifications and changes may readily occur to those skilled in the art without departing from the invention. Therefore, it is aimed to cover all such changes and modifications as fall within the full breadth and scope of the invention as defined in the claims which follow.

What is claimed is:

1. A quick assembly and disassembly, portable utility shed including:

a. a front panel, a rear panel, and first and second opposing side panels, and a pair of roof panels, each said panels having a support frame that is adapted to support an external siding;

b. each of said side panel support frames including an upper horizontal edge portion and a bottom horizontal edge portion, a first vertical edge portion and an opposing, second vertical edge portion, and tongue means on said first vertical edge portion and tongue means on said second vertical edge portion, each said first and second tongue means having latch pin-receiving holes therein;

c. said front panel support frame and said rear panel support frame each having a lower horizontal edge portion, an upper gable structure having an apex and including first and second members that incline downwardly from said apex, and a first vertical edge portion and an opposing second vertical edge portion, each said front and rear panel support frame vertical edge portions having groove means therein for being releasably engaged by a tongue means of said side panel frame;

d. latch pins for engaging said tongue means holes, whereby said front, rear, and side panel frames have an erected position wherein the tongue means of said, opposing side panel frames are engaged in the groove means of said front and rear panel frames to releasably secure said tongue means in said groove means;

e. each of the gable structures of said front and rear panel frames having generally horizontally extending first connector means at an upper portion of said gable structures; and f. each said roof panel frames having a lower longitudinal edge portion, an upper longitudinal portion, opposing parallel side portions, an upper part, second connector means on the upper part of said roof frame for releasably engaging said first connector means to connect the upper part of said roof frame to the gable structures of said front and rear panels when placed in said erected position and means for releasably clamping the lower edge of said roof panel to the upper portion of said side frame.

2. A shed as defined in claim 1 wherein said first connector means comprises a pair of male connectors and said second connector means comprises a pair of female connectors.

3. A shed as defined in claim 1 wherein each of said side frames lie in a general plane, and said tongue means is a single vertically elongated element that extends in said plane.

4. A shed as defined in claim 1 wherein said first and second inclined gable members have upper surfaces for engaging the opposing parallel side portions of each of said roof frames.

5. A shed as defined in claim 2 wherein each of said male connectors comprises a generally horizontally extending rod, and each of said female connectors provides a socket for receiving each of said male connectors.

6. A shed as defined in claim 1 wherein the lower longitudinal edge portion of each of said roof frames has a downwardly-facing surface for engaging the upper edge portion each of said side panels.

7. A shed as defined in claim 5 wherein said inclined gable members include vertical walls and each of said female connectors have vertical walls engagable with said gable member walls to hold each of said roof frame against lateral movement relative to said gable members.

8. A shed as defined in claim 1 wherein each of said side frame upper portions has an elongate top surface and the lower edge of each said roof panels has an elongate bottom surface that is adapted to engage said side frame top surfaces.

9. A shed as defined in claim 1 including exterior siding attached to said front, rear, and side frames, the siding on each of said side frames having opposite vertical edge portions that are adapted to be placed in overlapping relationship with an edge portion of the siding of said front and rear panels, and means on each of said side panel siding edge portions, and on said front and rear siding edge portions for releasably connecting said overlapping edge portions.

10. A shed as defined in claim 9 wherein said connecting means on said side panel siding comprises a vertically extending socket, and said connecting means on said front and rear panel siding comprises a vertically extending tongue adapted to be releasably retained in said socket.

11. A shed as defined in claim 10 wherein said front and rear panel siding has a major surface, and wherein each of said front and rear panel siding edge portions are oriented at about 90° to said major surface.

12. A shed as defined in claim 11 wherein said front and rear panel edge portions are oriented at slightly less than 90° to said major surface.

* * * * *